United States Patent [19]

Koster

[11] Patent Number: 5,046,558

[45] Date of Patent: Sep. 10, 1991

[54] METHOD AND APPARATUS FOR REPAIRING CASINGS AND THE LIKE

[75] Inventor: Charles H. Koster, Alvin, Tex.

[73] Assignee: Nu-Bore Systems, Wichita Falls, Tex.

[21] Appl. No.: 460,810

[22] Filed: Jan. 4, 1990

Related U.S. Application Data

[62] Division of Ser. No. 295,290, Jan. 10, 1989, Pat. No. 4,913,758.

[51] Int. Cl.[5] ..... B65H 81/00; E21B 29/10

[52] U.S. Cl. ..... 166/243.000; 166/277; 242/7.22; 156/392

[58] Field of Search ..... 166/243, 277, 380, 381, 166/387; 242/7.22, 7.23; 156/94, 392, 391, 443

[56] References Cited

U.S. PATENT DOCUMENTS

| | | | |
|---|---|---|---|
| 3,364,993 | 1/1968 | Skipper | 166/277 |
| 3,470,057 | 9/1969 | Stuart, Jr. et al. | 156/392 |
| 4,008,114 | 2/1977 | Lindsey | 156/392 |
| 4,069,088 | 1/1978 | Cottman | 242/7.23 |
| 4,261,785 | 4/1981 | Hunter | 156/392 |

*Primary Examiner*—Terry L. Melius

*Attorney, Agent, or Firm*—Hopgood, Calimafde, Kalil, Blaustein & Judlowe

[57] ABSTRACT

An improved device and process for creating a lining in a bore transfers strip wrapped in overlapping spiral fashion about a mandrel to the bore wall such that the edge-to-edge relation of the spirally-wrapped strip is maintained from the mandrel to the bore wall. Adhesive is applied to the strip surface during wrapping thereof on the mandrel. The invention provides a new bore with a thin, strong, corrosion resistant lining over a preselected portion of its length that is substantially pressure tight internally and externally and leak proof thus permitting substantial reuse of the lined bore.

9 Claims, 4 Drawing Sheets

METHOD AND APPARATUS FOR REPAIRING CASINGS AND THE LIKE

This application is a division of U.S. Ser. No. 295,290, filed Jan. 10, 1989, now U.S. Pat. No. 4,913,758.

The present invention is directed to various improvements in the process and apparatus for preparing and installing new linings in bores such as oil well casings which have developed cracks or holes from corrosion and are thereby considered threats to the environment, together with other unwanted effects. As another example, a perforated area initially designed to access a hydrocarbon reservoir can be patched to allow exploitation of another hydrocarbon producing zone.

BACKGROUND OF THE INVENTION AND THE PRIOR ART

In my co-pending United States patent application Ser. No. 223,557, now U.S. Pat. No. 4,865,127, the text of which is incorporated herein by reference I have described apparatus and method for wrapping a resilient strip material about a mandrel with the wrapped strip being held firmly against the mandrel at the ends thereof as by collar means which prevent unwrapping the wrap, inserting the mandrel into a bore to be lined and creating a lining at a selected place within the bore by unwrapping the strip material from the mandrel to create a lining consisting of spirally placed strip, e.g., metal strip interleaved with layers of a curable liquid resin which is held in place against the bore by resilience of the strip and bonded together by effecting curing of the resin. A downhole tool for effecting the lining, a machine for wrapping the tool and a process for creating the new lining were disclosed. An extensive testing program has led to a number of improvements in the apparatus and process which have led to an improved leak resistance upon pressure testing of the linings produced. The present application is directed to a description of the said improvements.

BRIEF DESCRIPTION OF THE INVENTION

Figure 1:
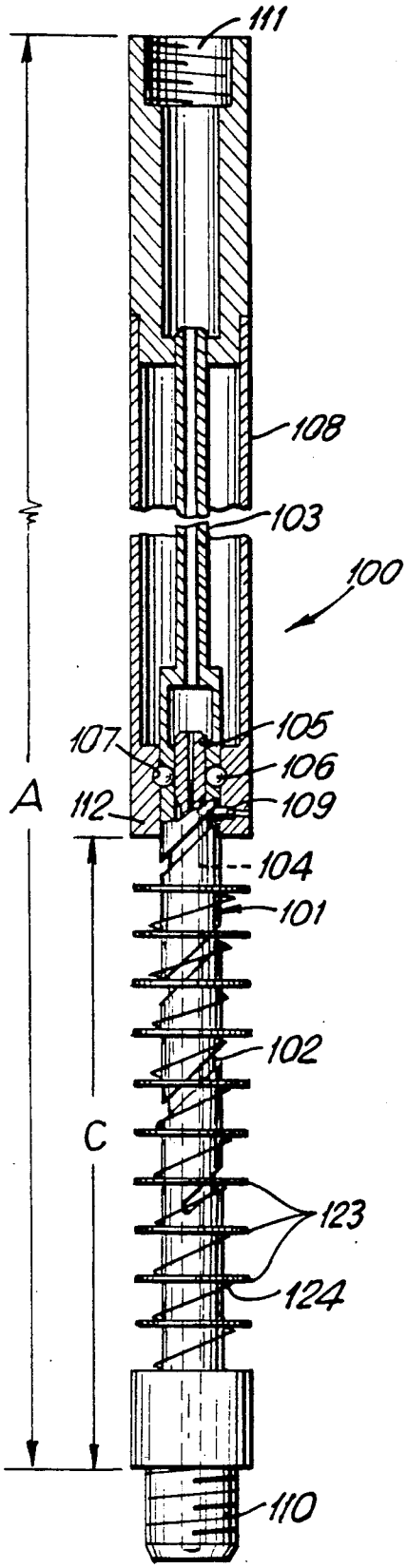
FIG. 1 depicts the mandrel of the invention in the extended, locked position.

In accordance with the present invention, the mandrel upon which the resilient lining strip is wrapped in overlapping spiral fashion is made of lockable inner and outer parts which, once the lock is released, telescope with respect to each other under the force of gravity, with the outer portion of the mandrel upon which the lining material is wrapped rotating with respect to the core portion, causing release of the resilient lining strip from the mandrel against the wall of the bore in which the mandrel is placed. Further improvements include preparing the mandrel from telescopable segments actuable sequentially from bottom to top so as to release the wrapped strip in spiral fashion against the bore wall from bottom to top of the patch area in the bore. The downhole tool itself is fitted not only with upper and lower packers but also with a supplemental packer below the lower packer, the function of which is to anchor the lower end of the tool to the bore wall. Once the spiral wrapped strip has been released against the bore wall, both upper and lower packers are inflated to release the collar means and to drive the upper and lower ends of the strip against the bore wall. This feature assists in controlling circulation of fluids in the bore in the region of the tool. In wrapping the strip in spiral fashion about the mandrel of downhole tool, liquid curable resin is spread directly against the strip surface. The improved mandrel of the invention permits suspension thereof in a bore to be lined on a wire, jointed straight tubing, or coiled tubing. Since rotation of the mandrel in the bore to effect unwrapping of the wrapped liner material therefrom is controlled by means within the mandrel utilizing the force of gravity, turning of the mandrel from the surface is rendered unnecessary.

The wrapping machine itself has also been improved to provide ready adaptation to the lining of bores of varying diameters.

DETAILED DESCRIPTION OF THE INVENTION

The testing program mentioned thereinbefore involved a consideration of the geometry of the patch created by the wrapped lining material which is initially wrapped in overlapping layers about the mandrel. This wrapping is transferred from the mandrel outside diameter (OD) to the bore wall inside diameter (ID) to be repaired. The inner diameter of the bore to be repaired must, perforce, be larger than the diameter of the mandrel bearing the wrapped lining material since the mandrel fits within the bore. This means that if the liner is transferred laterally from the mandrel to the bore, the edge-to-edge spacing of adjacent turns of the strip material wrapping will have to increase due to the increase in diameter of the wrapping. In order to maintain the same edge-to-edge spacing between adjacent turns of the wrapped liner strip, the overall length or height of the liner material wrapping must be decreased as the unwrapping of the liner from the mandrel to the bore wall proceeds. Stated in another way, the pitch of the spiral created in the spirallywrapped liner material by the wrapping operation must decrease when the liner material is transferred from the mandrel on which it is wrapped to the bore surface to be repaired if this edge-to-edge spacing of the strip is to be maintained during the transfer. It can be seen that the area of material wrapped on the mandrel is finite. It has been found that the strip material area applied to the bore wall should be the same as it was on the mandrel surface. The diameter of the patch is greater than the diameter of the mandrel, hence the cylindrical height of the patch must be less than the cylindrical height of the strip material spirally-wrapped on the mandrel.

The means invented to accomplish the special purpose of the invention will be described under the following headings:

THE MANDREL OR DOWNHOLE TOOL

Figure 2:
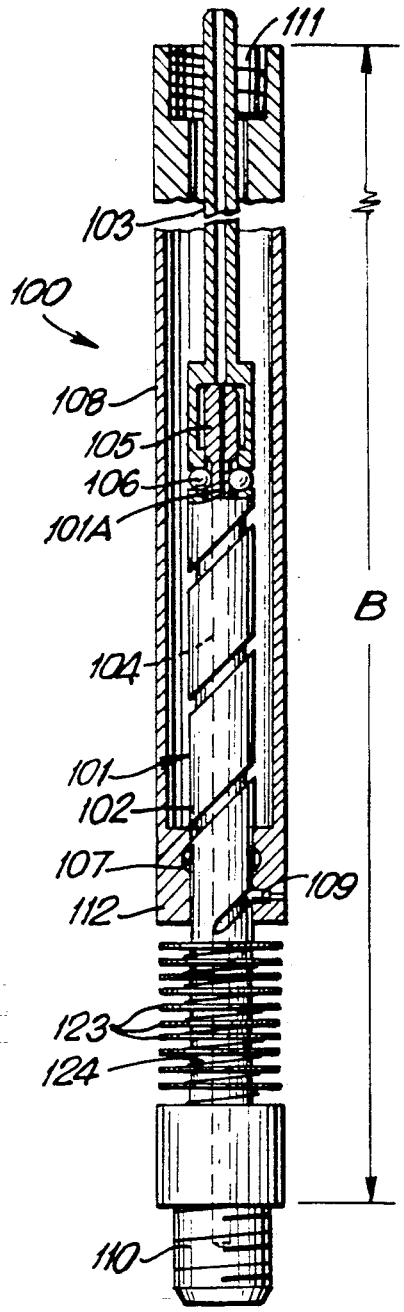
FIG. 2 depicts the mandrel of the invention in the unlocked, telescoped position.

As shown in FIGS. 1 and 2, the mandrel 100 comprises inner hollow section 101 bearing lead screw 102 and upper push-rod 103 fixed to inner hollow section 101, and outer tube 108 which is telescopable and rotatable with respect to hollow section 101. Moveable push-rod 104 fits within hollow section 101 and has an enlarged end section 105 which closely fits the inner wall of hollow section 101 so as to hold balls 106 therebetween. Balls 106 may fit in detents 107 in the inner wall of outer tube 108 when the mandrel is in locked position. As long as the enlarged end of lower push-rod 104 bears against balls 106 in the position shown in FIG. 1, outer tube 108 is locked to hollow section 101. When push-rod 104 is raised as in FIG. 2, a reduced section 101A thereof is brought opposite balls 106 and outer tube 108 becomes unlocked from inner hollow section 101 by release of balls 106 from the locked position. Roller pin 109 inserted into the inner wall of outer tube 108 engages lead screw 102 causing rotation of outer tube 108 with respect to inner section 101. The mandrel may be fitted with male 110 and female 111 threaded connectors to join mandrel sections into a given downhole tool. It will be appreciated that at the bottom end by a supplemental or anchoring packer devoted to that purpose and inflatable by hydraulic pressure applied through the hollow center of the mandrel. Accordingly, once balls 106 are released by action of the lower moveable push-rod 104, the mandrel will be free to descend under the action of gravity. The collapsing action of the outer tube 108 with respect to the lead screw tube 101 will shorten the mandrel as shown by the length "A" on FIG. 1 and the length "B" shown on FIG. 2. Shortening the mandrel to the length "B" shown on FIG. 2 exposes a portion of upper push-rod 103 above the upper end of mandrel 100. This actuates the push-rod in the adjoining upper mandrel section and permits release of wrapped liner material therefrom. It will be noted that the lower end of outer tube 108 terminates at 112. Since the entire length of mandrel 100 is to be wrapped with liner strip, a collapsing section of mandrel 100 is provided as indicated at zone "C" thereon upon which liner strip may be wrapped. The collapsing section may comprise a series of washers 123 which may be kept separate by springs 124. Such a structure permits wrapping strip about the mandrel but still permits the requisite unwrapping action caused by relative motion of the mandrel parts and concomitant rotation of outer tube 108.

It is to be appreciated that the completed downhole tool, securely locked to prevent rotation and unwrapping of the strip liner material, with upper and lower packers at the termini of the wrapped strip area, with cuffs or collars securely holding the upper and lower ends of the wrapped strip, with a supplemental packer at the lower end to provide an anchor to the bore and a centralizer if needed is lowered down the bore from a suspending means. The defects to be patched may be many hundreds or even thousands of feet down the bore. The lower packer 29 and supplemental packer 138 are rigidly attached.

Once the tool has been located at the position of the bore to be patched, the supplemental packer is inflated to anchor the tool in the bore. Preferably, hydraulic pressure transmitted from a pump on the surface through the hollow suspending means and the hollow tool is used to inflate the packer. The push-rod of the bottom mandrel section is then actuated by a piston located below the mandrel section and actuated by hydraulic pressure after the bottom packer is anchored. Rotation of the bottom mandrel portion then proceeds as the locking mechanism is released. The strip unwrapping then proceeds sequentially up the tool, which is lowered slowly against the anchored supplemental packer until all the wrapped strip material is released against the bore wall. Both upper and lower packers are inflated against the bore wall to force the retaining cuffs thereagainst. The packers are then deflated. The resin between layers of strip is then cured, as by hot water forced down the hollow center of the tool and circulated along the patch.

THE PROCESS

Figure 3:
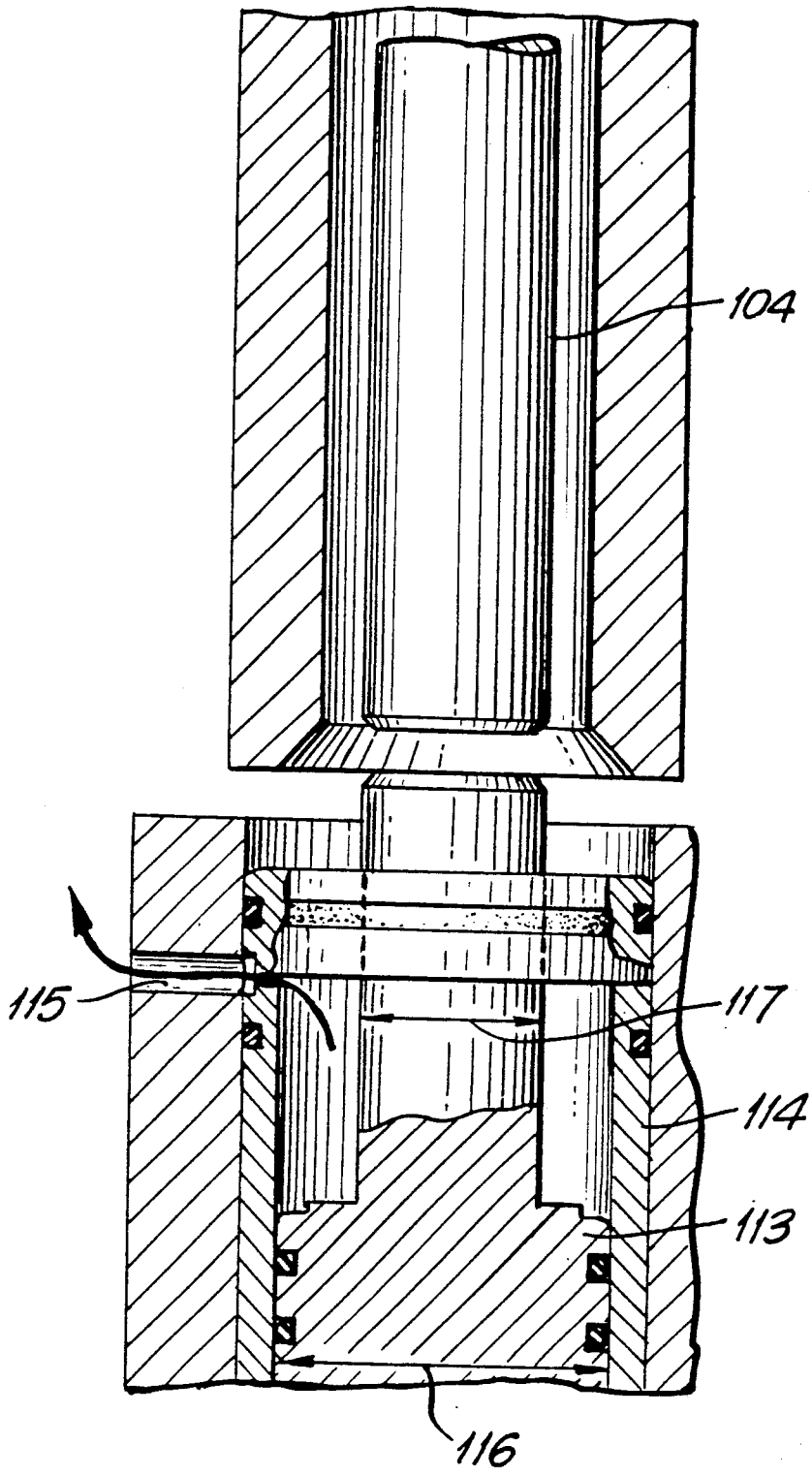
FIG. 3 depicts the hydraulic piston for actuating the lower push-rod in the lowermost mandrel segment.

The process of the invention comprises preparing the mandrel described hereinbefore by assembling end-to-end a series of mandrel segments which are individually collapsible in the controlled fashion described. Liner strip made of resilient material, which may be, for example, glass fiber or carbon fiber reinforced plastic material, corrosion-resistant metal material such as beryllium copper, etc. is wrapped in spiral fashion about the mandrel with a layer of a curable resin being deposited on the strip surface between overlapping layers of the wrap. The ends of the wrap are then securely fastened to the mandrel surface by means such as metallic cuffs or collars which lock together. The length of the wrapped strip is substantially the length of the patch to be made in the bore to be repaired. The length of each mandrel segment is that which can conveniently be handled in the field, e.g., about thirty feet. The wrapped downhole tool is then lowered down the hole to be repaired to the point or areas of the leak to be patched and is locked against the bore wall by inflation of a packer at the lower end of the tool. For this purpose, it is convenient to use a coiled tubing unit such as that commonly used in oil field practice for the purpose of suspending the tool down the hole. Hydraulic commands can be transmitted down the tubing and used to control the desired functions of the tool in the hole. Pressurization to inflate the lower-end packer can also be used to actuate the inner push-rod in the lowermost mandrel segment to initiate unwrapping of the liner strip therefrom. This may be accomplished by actuation of a piston 113 at the bottom of the lowermost mandrel segment as shown in FIG. 3 of the drawing. Piston 113 operates within cylinder 114 located below the lowermost mandrel segment and actuates the lower push-rod 104 of the said mandrel segment. Piston 113 operates by differential hydraulic pressures shown by the large piston diameter 116 as against the small push-rod diameter 117. A vent 115 may be provided in the cylinder wall to prevent hydraulic locking of piston 113. Once the lower mandrel segment is unlocked, unwrapping of the strip proceeds by rotation of the outer tube section 108 with respect to the inner lead screw tube 101 and unwrapping of the wrapped strip proceeds sequentially upwards as the mandrel segments are actuated sequentially from bottom to top. Once unwrapping is complete, both the upper and lower packers, which are located beneath the cuffs holding the wrapping strip are actuated hydraulically and the cuffs are forced against the bore wall, where they remain by spring action of the cuff material, which is preferably made of spring temper metal. The upper and lower packers may then be deflated and the liquid resin between the layers of liner strip is cured. If the resin employed is a thermosetting resin, hot water may be circulated through the tool to the inside surface of the patch. Once a cure has been effected, the locking packer is deflated and the tool is removed from the hole. The resin employed may be of any type which may be cured in the hole.

THE SURFACE TOOL OR MATERIAL APPLICATION DEVICE

Figure 4:
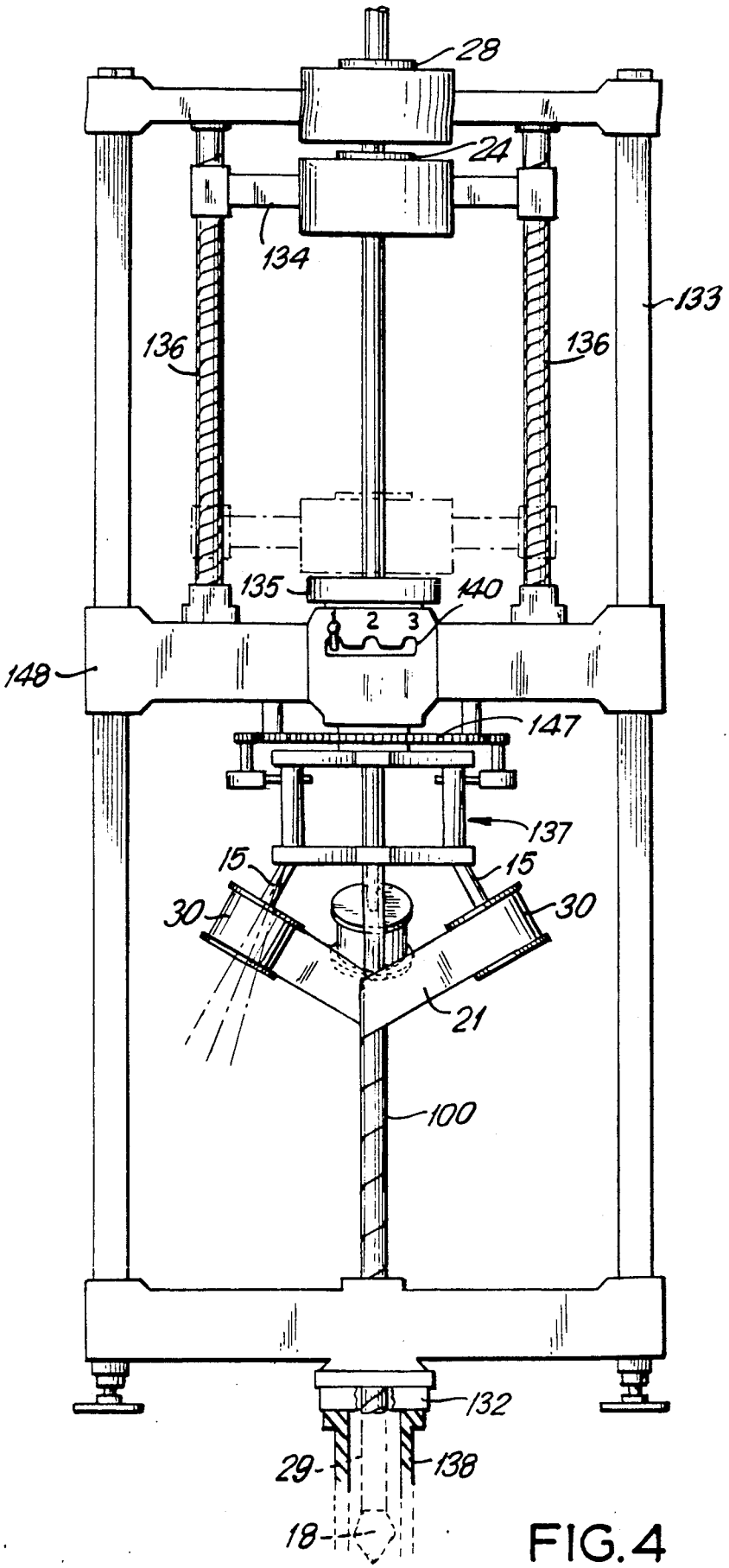
FIG. 4 depicts in elevational view the improved wrapping machine of the invention.

FIG. 4 depicts in elevational view an improved machine for spiral wrapping liner strip about the mandrel of the invention. The machine is adapted to fit atop a wellhead 132 so that, as wrapping of the mandrel 100 proceeds, the wrapped mandrel may be lowered down the hole. The machine comprises a frame having a moveable cross-head 134 bearing lower collet 24. A fixed cross-head 148 bears a power-head 135 containing the lead screw drive mechanism which controls the rate at which the cross-head 134 moves up and down the lead screws 136. The lead screw drive mechanism also coordinates the rotation of the winding mechanism 137 to the downward travel of the mandrel section being wound to produce the proper wrap of strip 21 about the mandrel. Collets 24 and 28 mounted on the moveable cross-head and the frame, respectively, serve to prevent the tool from dropping down the well. Collet 24 is open while the cross-head 134 is raised and is closed to grip the mandrel when cross-head 134 descends. Collet 28 is closed while the cross-head 134 rises and open when cross-head 134 descends. The collets are of the type which is normally closed and are opened by application of hydraulic pressure. Winding mechanism 137 supports spindles 15 which hold the coils of liner strip 21 on spools 30. A centralizer 18 and the bottom or anchoring packer 138 are shown in broken line at the bottom of mandrel 100. Lower packer 29 is also indicated.

Figure 5:
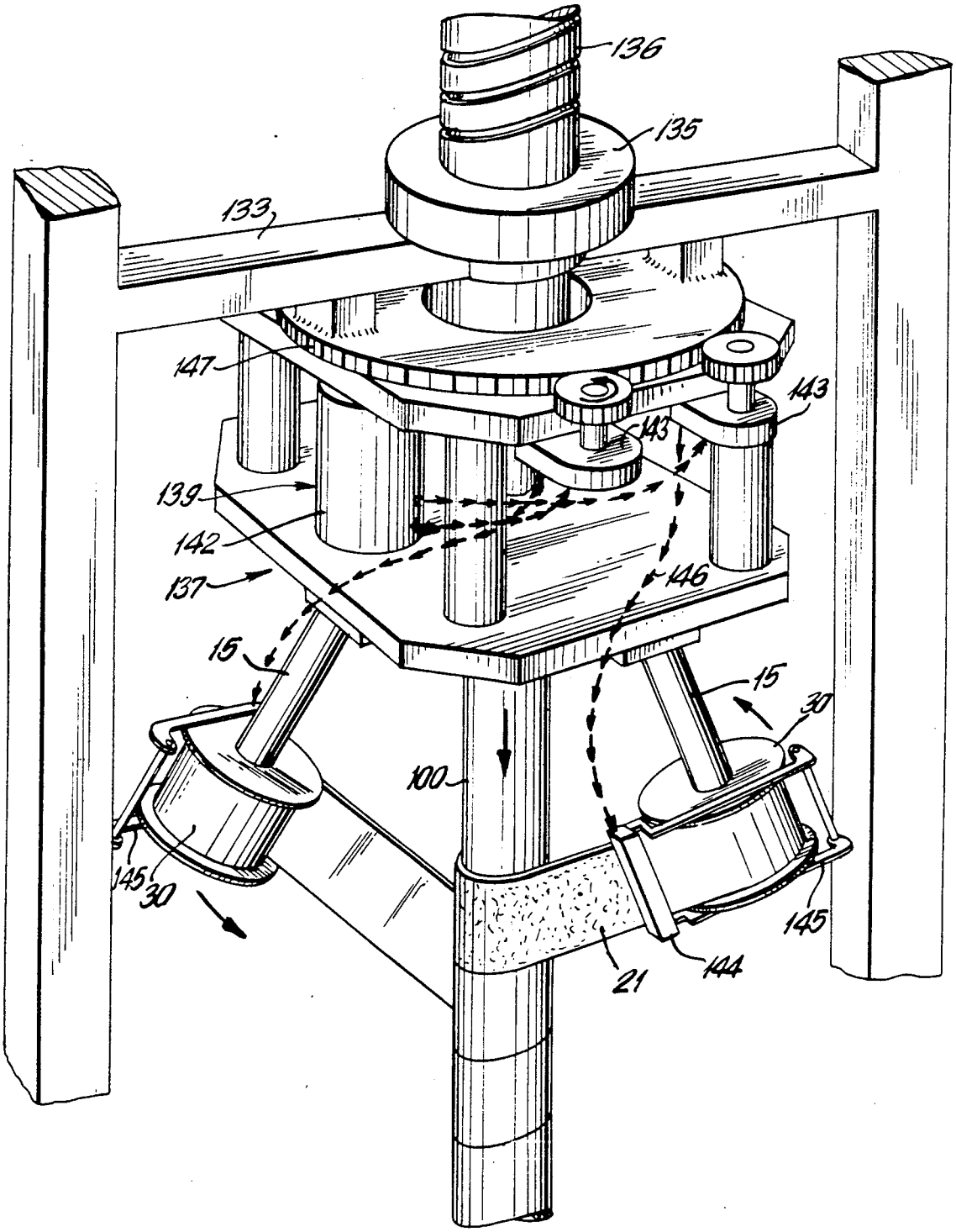
FIG. 5 depicts in prospective view a more detailed view of the wrapping machine.

Resin applicator assembly 139 feeds liquid resin directly to a face of the uncoiling strip 21 and is explained in more detail in relation to FIG. 5.

Advantageously, the machine is designed to run several casing patch sizes ($4\frac{1}{2}''$, $5\frac{1}{2}''$, $7\frac{5}{8}''$, for example) using the same basic machine. For this purpose lead screw mechanism 135 is provided with change gears, spindles 15 are provided with a mechanism to make the proper angle in relation to the mandrel section being run. The change gears incorporated in the lead screw drive mechanism provide the correct relationship between rotation of winding mechanism 137 and downward travel of mandrel segment 100 with moveable cross-head 134 so that the proper wrap will result. The change gears can be shifted as indicated by gear shift 140 to provide the correct ratio. The spindle angle can be controlled by a cam adjuster with a lobe setting for each size. The collet jaws 24 and 28 must be changed out for the mandrel size being run.

It is to be appreciated that the mandrel is prevented from turning during the wrapping operation and that all mandrel segments are wrapped while in the locked position. The winding mechanism 137 is provided with a brake 141 which prevents reversal of winding mechanism 137 when moveable cross-head 134 is being raised.

FIG. 5 shows in more detail the mechanism for applying liquid resin to the surface of strip 21. Winding mechanism 137 rotates counter clockwise looking down and includes spindles 15 on which spools 30 are mounted. Liquid resin is fed from pressurized canister 142 to metering pumps 143 of the positive displacement type thence to resin applicator head 144 which is mounted on pivoting arms 145. Arms 145 are attached to spindles 15. Arrows 146 indicate the path of the liquid resin. Pumps 143 are geared to fixed gear 147 and thus supply resin only when winding mechanism 137 is rotating. The resin applicator head 144 consists of a hollow container having a narrow slit, e.g., 0.125 inch, facing the strip surface on which the applicator is in riding contact with the slit extending completely across the width of the strip being coated. A resin applicator is supplied for each of strips 21 being wound.

It is found in practice that application of liquid thermosetting resin, e.g., a liquid epoxy, works very well and that the resin acts as a lubricant. Of course, other adhesives and resins which may be thermosetting, time-setting, etc. as those skilled in the art will readily understand, may be employed. The adhesive coating between the liner strip and the bore being lined insulates against electrolysis.

The improved mandrel design and machine provide capability of using a wire line or coiled tubing unit (standard oil field procedures) for the purpose of lowering the wrapped mandrel down a hole or bore, e.g., an oil well. This benefit resulted from elimination of the need for mechanical rotation from the surface. In the case of the wire line, self-contained pressure vessels can be incorporated in the tool and actuated from the surface by electrical or other means supplied from an appropriate location. Heating elements can be built into the tool and utilized to cure adhesive.

What is claimed is:

1. A machine for preparing a tool designed to repair leaking sections of well casing which comprises:

(1) a rectangular frame having upper and lower openings at substantially the center line;

(2) a fixed crosshead in said frame;

(3) a movable crosshead bearing a first collet means;

(4) said fixed crosshead bearing rotatable material payoff means, drive means therefor and brake means permitting rotation of said material payoff means in a single direction only;

(5) means for elevating and lowering said movable crosshead;

(6) a second collet means fixed about the said upper opening on said frame;

(7) means for feeding mandrel material through said first collect means, said drive means and said material payoff means and through the lower opening in said frame; and (8) means for holding strip material on said material payoff means whereby mandrel material may be wrapped portion by portion with said material to a desired length to form a tool for repairing oil well casings.

2. A machine in according with claim 1 wherein said collets are normally in a closed position and are opened hydraulically.

3. A machine in according with claim 2 wherein at least one of said collets is in position during operation.

4. A machine in according with claim 1 wherein said means for elevating and lowering said movable cross-head comprises a hollow lead screw operated by said drive means.

5. A machine in according with claim 4 wherein said brake means is set to prevent rotation of said material payoff means when said drive means is employed to elevate said movable crosshead.

6. A machine in according with claim 1 wherein said means for elevating and lowering said movable cross-head is a hollow lead screw and said rotatable material payoff means is a tube surrounding said lead screw.

7. A machine in accordance with claim 6 wherein said lead screw and said rotatable material payoff means are operated by a common reversible power head which is ratcheted with respect to said rotatable material payoff means such that said rotatable material payoff means rotates only when said lead screw is descending.

8. A machine in accordance with claim 1 wherein said collet means fixed to said movable crosshead is open when said movable crosshead is rising and closed when said movable crosshead is descending.

9. A machine in accordance with claim 1 wherein said rotatable material payoff means is provided with a plurality of axles angularly spaced about material payoff means and located at an angle with respect to the centerline of said material payoff means, said axles being adapted to hold reels of strip material.

* * * * *